US005917432A

United States Patent [19]

Rathbone

[11] Patent Number: 5,917,432

[45] Date of Patent: Jun. 29, 1999

[54] INTELLIGENT INTERSECTIONS

[76] Inventor: Daniel B. Rathbone, 6813 Jeremiah Ct., Fairfax Station, Va. 22039

[21] Appl. No.: 08/941,703

[22] Filed: Oct. 1, 1997

Related U.S. Application Data

[60] Provisional application No. 60/027,154, Oct. 2, 1996.

[51] Int. Cl.[6] ..... G08G 1/095

[52] U.S. Cl. ..... 340/907; 340/917; 340/933; 701/118; 701/120

[58] Field of Search ..... 340/907, 906, 340/916, 917, 920, 933; 701/118, 120

[56] References Cited

U.S. PATENT DOCUMENTS

| | | | |
|---|---|---|---|
| 1,988,633 | 1/1935 | Sibley | 340/907 |
| 2,162,302 | 6/1939 | Greene | 340/907 |
| 2,260,051 | 10/1941 | Pardee | 340/907 |
| 2,287,685 | 6/1942 | Jelinek | 340/907 |
| 3,161,853 | 12/1964 | Hart | 340/907 |
| 3,231,856 | 1/1966 | Auer | 340/926 |
| 3,257,552 | 6/1966 | Converso | 340/907 |
| 3,334,554 | 8/1967 | Adams | 340/907 |
| 3,593,261 | 7/1971 | Dominguez | 340/907 |
| 4,727,371 | 2/1988 | Wulkowicz | 340/917 |
| 5,074,706 | 12/1991 | Paulos | 340/907 |

FOREIGN PATENT DOCUMENTS

| | | |
|---|---|---|
| 954101 | 9/1974 | Canada . |
| 2 263 298 | 7/1993 | United Kingdom . |

*Primary Examiner*—Jeffery A. Hofsass
*Assistant Examiner*—Daryl C. Pope
*Attorney, Agent, or Firm*—Richard C. Litman

[57] ABSTRACT

A traffic intersection control system or intelligent intersection that analyzes in real time existing traffic flow at intersections to determine whether turn lanes need to be added, lengthened, or done away with, if the lane geometry needs to be modified, and if the time duration of the signals needs to be shortened or lengthened. Conventional, painted, pavement markings are replaced with intelligent pavement markers (IPMs). The IPMs display an intense white or yellow light (e.g., an LED) or can be switched off. Overhead, electronic, lane usage signs alert drivers as to which lanes are through lanes, which lanes are for on-coming traffic, and which lanes are turn lanes. The intersection controller analyzes data about current traffic flow and historical data to determine the most efficient intersection configuration and signal timing for a set time period. If necessary, the controller reconfigures the intersection by controlling the IPMs and overhead lane usage signs using communications equipment.

2 Claims, 3 Drawing Sheets

INTELLIGENT INTERSECTIONS

CROSS-REFERENCE TO RELATED APPLICATION

This application claims the benefit of U.S. Provisional Patent Application Ser. No. 60/027,154, filed Oct. 2, 1996.

BACKGROUND OF THE INVENTION

1. Field of the Invention

The present invention relates generally to traffic control systems and, more specifically, to a control system that controls traffic flow at signalized intersections by changing lane usage in real time in response to changing traffic patterns.

2. Description of the Related Art

For as long as there have been traffic signals there have been traffic jams. Every motorist has encountered the frustrations associated with long delays at traffic intersections due to un-synchronized traffic signals. A major contributor to these delays are situations wherein during the morning rush hour, in one direction traffic is backed up for miles, and in the opposite direction traffic is very light. During the evening rush hour the pattern reverses itself. While the number of overall lanes for each road may be adequate, an inadequate number of through lanes or left/right turn lanes in the busy direction is a major contributor to traffic congestion on many roads.

In an effort to minimize traffic congestion caused by the above described situation, traffic engineers have attempted to improve the efficiency of signalized traffic intersections by: changing signal and detection hardware and software; improving signs and markings to better inform motorists; and improving traffic flow by making changes to traffic regulations (e.g., right turn on red). In addition, traffic engineers have installed electronic, overhead, lane usage signs that increase or decrease the number of usable lanes in a given direction during certain time periods. For example, during morning rush hour the electronic signs may allow four eastbound lanes and only two westbound lanes. Conversely, during the evening rush hour the electronic signs will allow only two eastbound lanes while allowing four westbound lanes. This type of control system, however, is preprogrammed such that at certain time periods on certain days (e.g., weekdays) the system will allow a preset number of traffic lanes in each direction. There are no provisions for real time analysis of traffic flow and real time automatic adaptation of lane control in response to changes in traffic flow. Consequentially, the system does little to alleviate traffic congestion during off peak hours or traffic congestion due to unforeseen circumstances.

Several traffic control systems have been described in the patent literature. U.S. Pat. No. 2,260,051 issued to Pardee on Jun. 24, 1940, shows a system of traffic control wherein barriers are raised and lowered automatically to vary the effective width of a roadway. U.S. Pat. No. 2,287,685 issued to Jelinek on Jun. 23, 1942, discloses lighted curbs that raise and lower to divide traffic depending on the rush hour. U.S. Pat. No. 3,334,554 issued to Adams on Aug. 8, 1967, discloses a temporary, traffic directing marker. U.S. Pat. No. 3,593,261 issued to Dominguez on Jul. 13, 1971, shows a traffic lane control apparatus with illuminated divider strips, that responds to the density and direction of traffic to control lane usage. U.S. Pat. No. 3,257,552 issued to Converso on Jun. 21, 1966, U.S. Pat. No. 5,074,706 issued to Paulos on Dec. 24, 1991, Canadian Patent No. 954,101 issued on Sep. 3, 1974, and British Patent Application No. 2,263,298 published Jul. 21, 1993, all teach methods of mounting a lighted indicator on pavement. These prior art devices do not teach a traffic intersection control system having illuminated lane markers, overhead traffic control signs, and the ability to change the lane geometry of an intersection based on real time analysis of traffic flow.

None of the above inventions and patents, taken either singly or in combination, is seen to describe the instant invention as claimed.

SUMMARY OF THE INVENTION

The aforementioned problems are overcome through the use of the traffic intersection control system of the present invention, that optimizes the number of turn lanes (and their length) and through lanes at congested intersections. The traffic intersection control system has the ability to, in real time, add or do away with exclusive turn lanes, change the length of exclusive turn lanes, and change the traffic direction of lanes. The ability to monitor and analyze traffic volumes at intersections in real time allows the control system to determine the volume to capacity (v/c) ratios and average vehicle delays on all lanes approaching the intersection. Traffic engineers, through traffic management centers, will have the ability to respond effectively to variations of traffic flow in real time.

The traffic intersection control system (intelligent intersection) of the present invention includes three main components: intelligent pavement markers (IPMs); lane usage signs; and detection, communication, and control equipment. The intelligent pavement markers (IPMs) replace conventional, painted, pavement markings with markers that can be illuminated with a yellow light (for dividing two-way traffic), illuminated with a white light (for dividing traffic in lanes going the same direction) or turned off. Overhead, electronic, lane usage signs alert drivers as to which lanes are through lanes, which lanes are for on-coming traffic, and which lanes are turn lanes. These lanes usage signs are already in use on major roads.

The detection, communication, and control equipment of the present invention uses historical data concerning traffic flow, to assist in determining an ideal lane configuration (or geometry) for the intersection. In addition to the historical data, real time existing traffic flow at the intersection is sensed in each lane, to determine a present average delay for the present traffic and intersection configuration. Many existing intersections already include the traffic sensors (usually a magnetic loop device). The intersection controller analyzes the data about current traffic flow and the historical data to determine the most efficient intersection configuration and signal timing for a set time period, to minimize the average delay through the intersection.

Once an ideal configuration is determined, intersection controller changes the intelligent pavement markers and the lane usage signs are remotely using an appropriate communications device (RF, infrared, etc.). The intersection then undergoes a transition period wherein traffic is allowed to stabilize to the new traffic flow. After the transition period, the controller again evaluates the traffic flow to determine if any other changes are needed.

Accordingly, it is a principal object of the invention to provide a traffic intersection control system.

It is another object of the invention to provide a traffic intersection control system having illuminated road studs that delineate the number and direction of traffic lanes.

It is a further object of the invention to provide a traffic intersection control system having overhead electronic signs that further indicate lane function and direction.

Still another object of the invention is to provide a traffic intersection control system having the means to analyze and determine, in real time, an ideal lane configuration.

It is an object of the invention to provide improved elements and arrangements thereof in an apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 3:
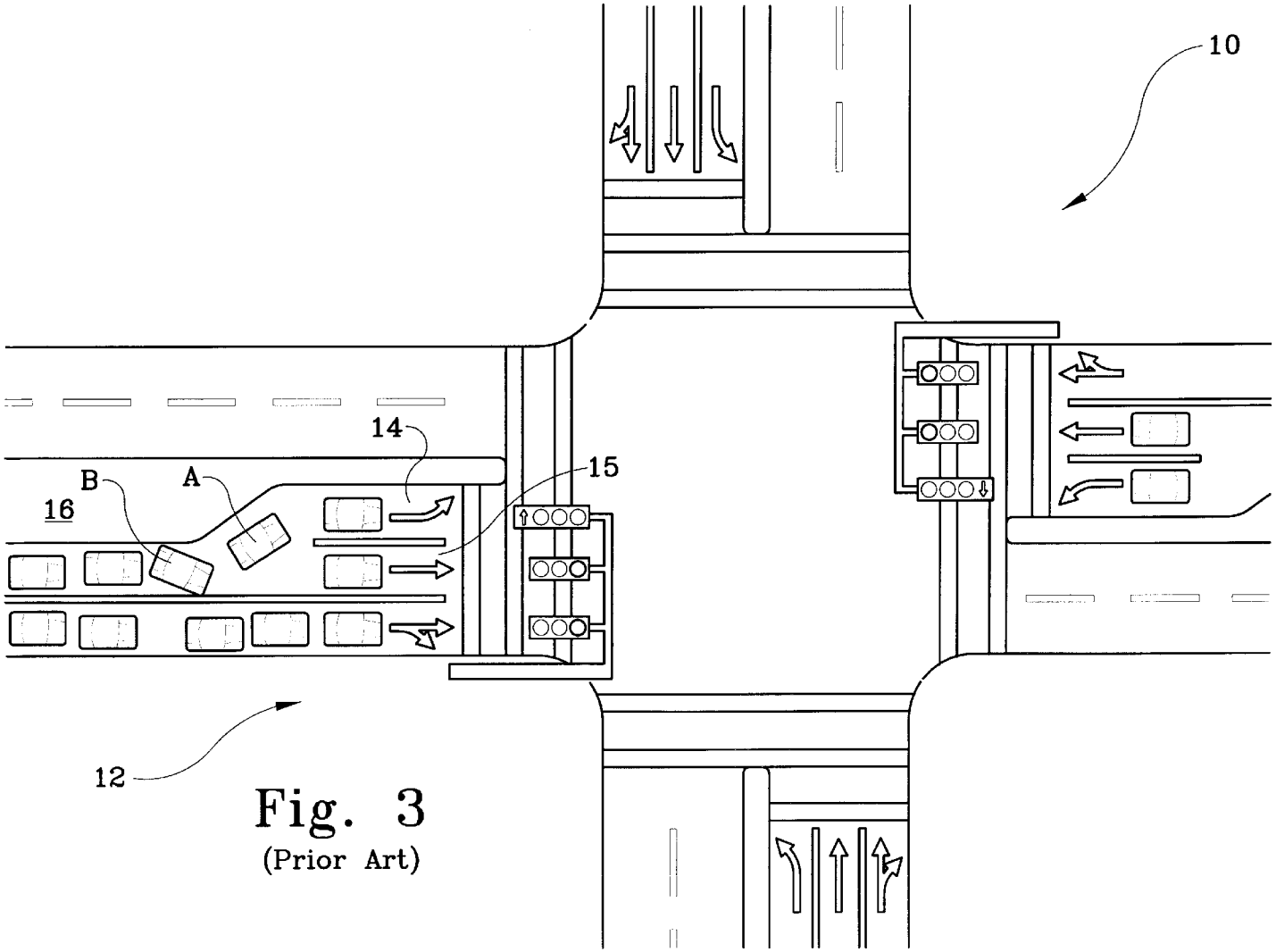
Fig. 3 (Prior Art)
FIG. 3 is a top plan view showing a conventional intersection.

FIG. 3 of the drawings shows a conventional intersection 10, wherein traffic is congested in the eastbound lanes 12. The congestion is a result of a left turn lane 14 that is too short and thereby forces left turning car A to partially block cars from proceeding in exclusive through lane 15. Car A prevents car B and subsequent cars behind car B from proceeding in lane 15 and hinders the overall efficiency of conventional intersection 10. In addition, a permanent median strip 16 prevents the modification of lanes to increase the overall efficiency of the intersection.

Figure 1:
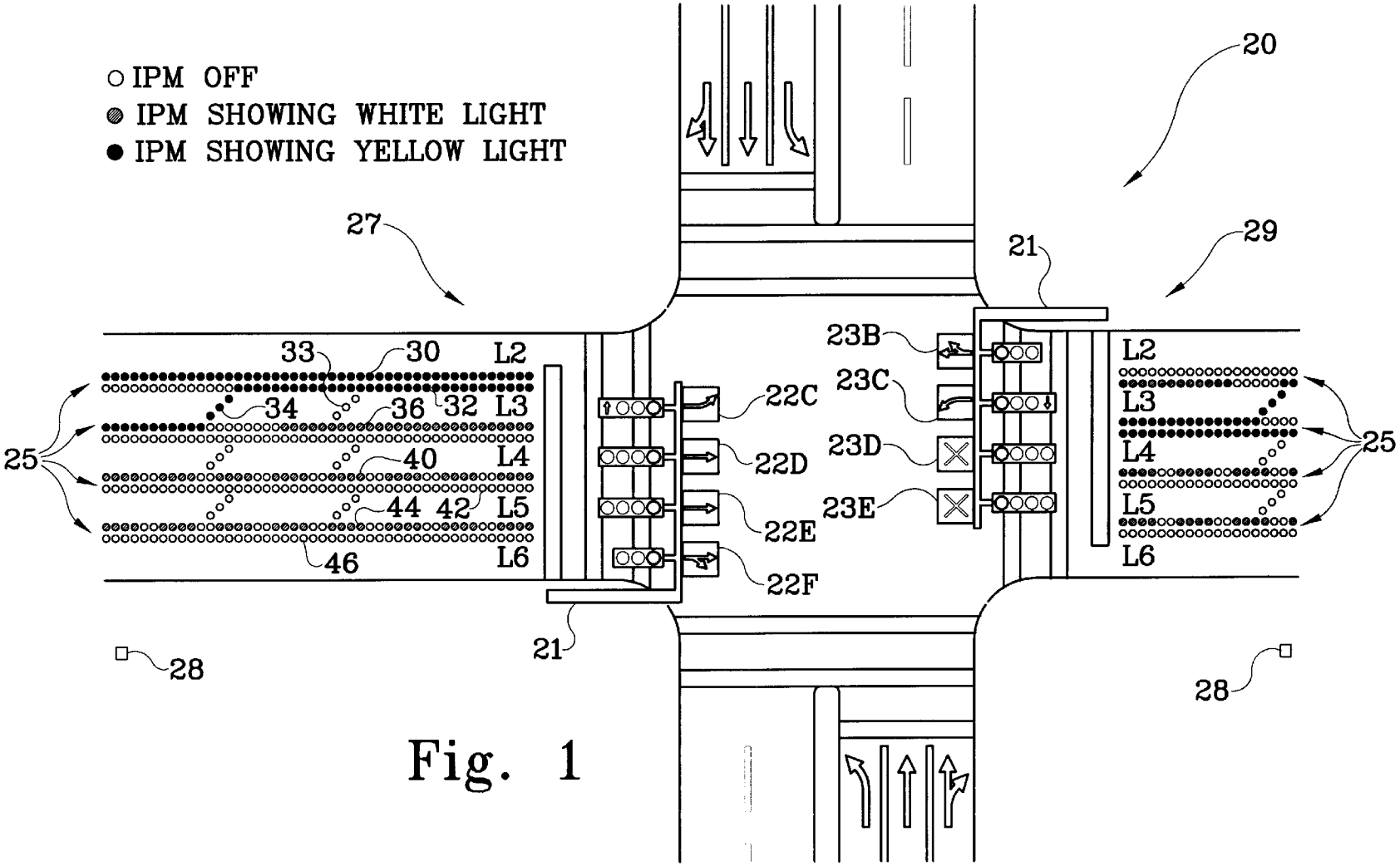
FIG. 1 is a top plan view showing the traffic intersection control system of the present invention.

To overcome these drawbacks, the present invention uses a traffic intersection control system 20 as is shown in FIG. 1. The term used for this type of traffic intersection control system 20 is "intelligent intersections". An intelligent intersection is an intersection that can be reconfigured in real time by adding or doing away with exclusive turn lanes, changing the length of exclusive turn lanes, and changing the traffic direction of lanes. Intelligent intersection 20 is comprised of three main components: intelligent pavement markers (IPMs) 25; lane usage signs 21; and detection, communication, and control equipment.

The intelligent pavement markers (IPMs) 25 replace conventional, painted, pavement markings, and differ from them in that the IPMs 25 can each display either a yellow or a white intense light (e.g., an LED), or be switched off. The control of the yellow or white lights of the IPMs 25 can be done remotely, using installed or existing communication technology, (infrared, RF, ultrasound) that communicates with a microprocessor (not shown) for controlling the signals at the intelligent intersection 20. In addition to their use in configuring the intersection 20, IPMs 25 have the following advantages over standard painted markings:

provide increased visibility under wet weather conditions, have more durability than painted lines, and create a secondary warning because of vehicle vibration and audible tones produced by vehicles crossing the markers.

The second main component is the overhead lane usage signs 21 which have the ability to change the traffic direction and function of traffic lanes approaching intelligent intersection 20. Each lane includes an overhead lane usage sign 21. For example, for eastbound traffic 27 in lanes L3 and L4 appropriate arrows are visible in signs 22C and 22D respectively, to indicate to eastbound drivers how to use lanes L3 and L4. Lane L3 is a left turn lane and therefore sign 22C shows a symbol for a left turn. Lanes L4 and L5 are exclusive through lanes and signs 22D and 22E display symbols identifying them as such. Lane L6 is a through or right turn lane and sign 22F displays a symbol identifying it as such. For westbound traffic 29 lane L2 is a through or right turn lane and sign 23B displays a symbol identifying lane L2 as such. Lane L3 is a left turn lane and sign 23C shows a symbol for a left turn. Lanes L4 and L5 are closed to westbound traffic and signs 23D and 23E display symbols (X's) identifying them as such.

The aforementioned IPMs are used to indicate lane divisions and are identified generally as 25. To identify lanes L4–L6 as adjacent eastbound traffic lanes, IPM rows 42 and 46 are turned off and IPM rows 40 and 44 have some individual IPMs turned off and some IPMs emitting white light, thereby mimicking conventional, dashed white, lane markings. IPMs 30, 32 and 34 emit a yellow light to indicate the line that traffic should not cross over (IPMs 30 and 32 mimicking a double yellow line). The yellow lights of IPMs 32 and 34 in conjunction with the emitted white light of IMPs 36 (IMPs 36 being lit in a continuous row to mimic a solid white line) indicate a left turn lane at the end of lane L3. The length of the left turn lane of lane L3 can be lengthened or shortened by causing one of IPM group 33 or IPM group 34 to emit yellow light, and turning the opposite group of IPMs off.

The third main component of intelligent intersection 20 is detection, communication and control. The detection of vehicle volumes for each lane of each roadway is required for the proper operation of the intelligent intersection 20. Several types of devices for sensing vehicles are presently available, one such type of device being a magnetic loop detector 28. The information from these devices is then transferred to the intersection controller 40. The intersection controller 40 is responsible for changing the lane configuration or geometry as well as the timing of traffic signals of the intersection. For example, if the number of westbound lanes in FIG. 1, needs to be increased, the intersection controller changes the appropriate overhead signs, IPMs and the associated traffic signals.

Figure 2:
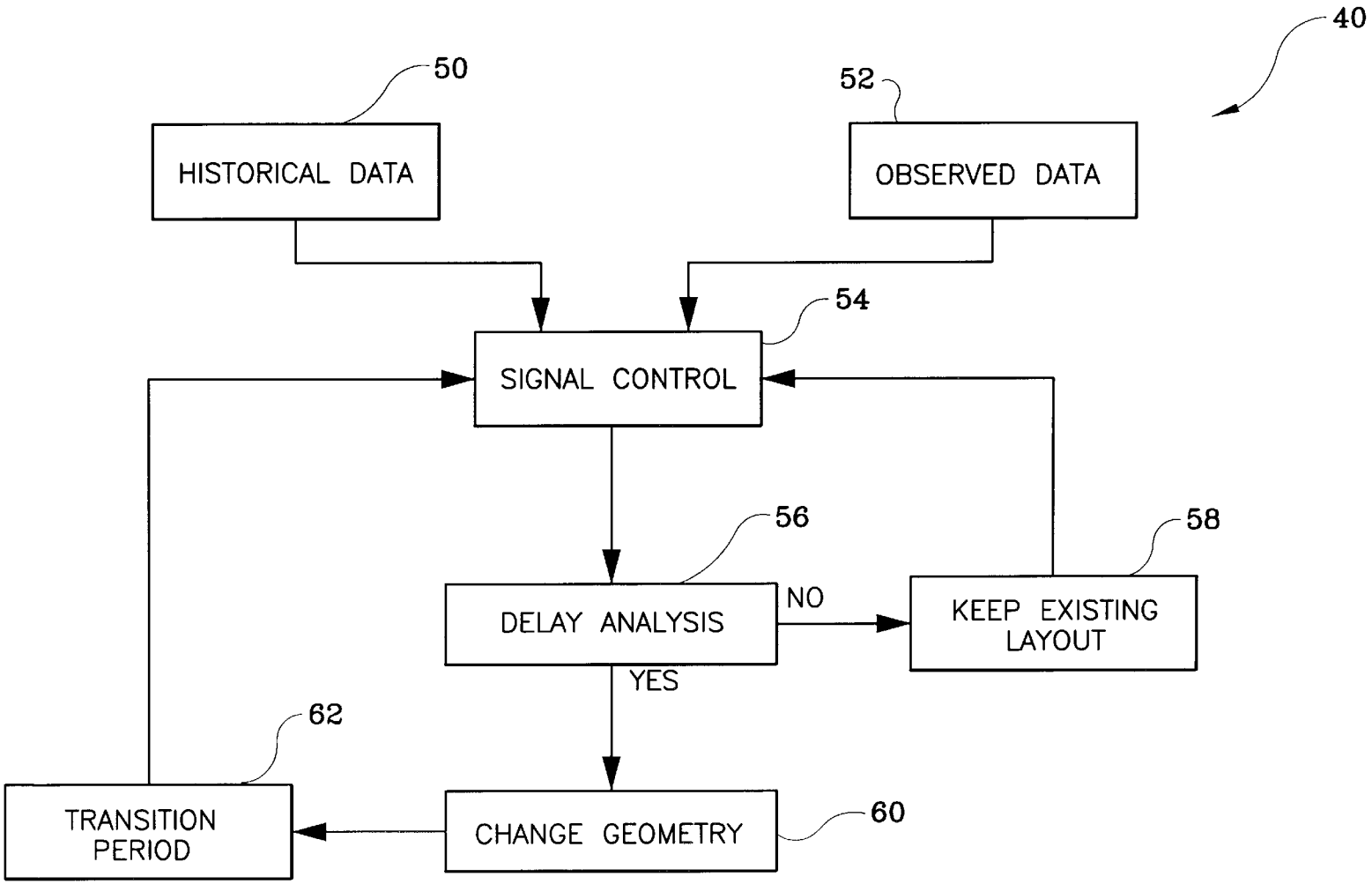
FIG. 2 is a flow chart showing how a determination is made on when to change the intersection geometry.

FIG. 2 shows a flow chart that indicates how the software of the intersection controller 40 determines the ideal configuration for the intersection. Historical data 50 includes information on historical traffic volume data for the intersection (traffic volume for each lane, time of day, day of the week, etc.). Observed data 52 includes data on present traffic volume as provided by the traffic sensors.

The historical and observed data are fed into signal control 54. Signal control 54 estimates future volumes for an analysis period, performs capacity calculations for alternate configurations or geometric layouts of the lanes of the intersection, and determines the proper signal settings and lane configuration that will minimize the average vehicle delay over the analysis period.

The next step involves delay analysis 56. During delay analysis 56 it is determined if the lowest average delay of the alternate configurations over the next analysis period would be less than the present delay. If not (NO), then the present layout or configuration is kept as indicated at 58 and control goes back to signal control 54 for another analysis. If, however, the delay would be reduced (YES), then control goes to change geometry 60 wherein the configuration of the intersection is changed so that optimum layout and efficiency is achieved. A transition period 62 allows vehicles to avoid being trapped in a lane that has changed direction or function, and provides for a stabilized analysis period. Once the transition period 62 is over, control then returns to signal control 54. The actual software and hardware of the traffic control computer and detection devices is well known, and no further discussion is deemed necessary.

Intelligent intersections allow traffic management centers much more control and the ability to respond to traffic bottlenecks caused by recurring or non-recurring congestion. The IPMs allow intelligent intersections to be more feasible and efficient, because they can be controlled to display an intense light in white or yellow or can be switched off remotely. Intelligent intersections can provide a significant amount of additional capacity on congested approaches to a signalized intersection. Due to intelligent intersections, transportation management centers will gain a significant amount of additional capability to react to varying traffic demands.

It is to be understood that the present invention is not limited to the sole embodiment described above, but encompasses any and all embodiments within the scope of the following claims.

I claim:

1. A traffic control system for an intersection having a number of roadways with each roadway including oncoming and outgoing traffic lanes, said system comprising:

a plurality of intelligent pavement markers located between the lanes, each marker of said plurality of markers being structured to display, selectively, one of an intense yellow light and an intense white light, markers displaying an intense yellow light indicating a division between the oncoming and outgoing lanes for each roadway, and markers displaying an intense white light indicating a division between lanes having traffic going in the same direction as each other;

a plurality of lane usage signs to indicate allowed maneuvers in the intersection for each lane; and traffic configuring means for determining an ideal configuration for the traffic lanes, the ideal configuration including a left turn lane with a specific length on one of the number of roadways and including an ideal length for the left turn lane, said traffic configuring means structured to control said plurality of intelligent pavement markers to provide the left turn lane and to change the specific length of the left turn lane to the ideal length; wherein each marker of said plurality of intelligent pavement markers is controlled by said traffic configuring means to display one of said white light, said yellow light or no light, to thereby change a configuration of the traffic lanes to the ideal configuration for the traffic lanes.

2. The traffic control system according to claim 1, further comprising traffic sensing means that determine data on an amount of traffic in each lane of each roadway, and provides said data to said traffic configuring means; and wherein said traffic configuring means determines the ideal configuration for the traffic lanes based on said data.

* * * * *